US006886275B1

(12) United States Patent
Westfall

(10) Patent No.: US 6,886,275 B1
(45) Date of Patent: May 3, 2005

(54) KICKING AID

(76) Inventor: William Mark Westfall, P.O. Box 90711, White Mountain Lake, AZ (US) 85912-0711

( * ) Notice: Subject to any disclaimer, the term of this patent is extended or adjusted under 35 U.S.C. 154(b) by 0 days.

(21) Appl. No.: 10/455,829

(22) Filed: Jun. 6, 2003

(51) Int. Cl.[7] ..... A43B 5/00
(52) U.S. Cl. ..... 36/133; 36/72 R; 36/128; 36/77 R
(58) Field of Search ..... 36/77 R, 72 R, 36/133, 132, 136, 128

(56) References Cited

U.S. PATENT DOCUMENTS 1,221,985 A * 4/1917 Golden ..... 36/128
1,726,198 A * 8/1929 Stahl ..... 36/128
2,268,435 A * 12/1941 Zucker ..... 36/7.5
2,552,700 A * 5/1951 Watts ..... 36/72 R
2,782,531 A * 2/1957 Frazier et al. ..... 36/133
3,851,410 A * 12/1974 Garland et al. ..... 36/133
4,899,470 A * 2/1990 Holland, III ..... 36/133

FOREIGN PATENT DOCUMENTS

EP 496931 * 8/1992

* cited by examiner

*Primary Examiner*—M. D. Patterson
(74) *Attorney, Agent, or Firm*—Gregory J. Nelson

(57) ABSTRACT

A football kicking aid for attachment to an athletic shoe. The aid has a toe piece having a cup which receives the toe of the shoe and preferably includes an aperture through which the front shoe cleat is inserted. A pair of straps extend from the sides of the toe piece and extend around the heel and attach to the opposite strap at the opposite side for quick and snug placement and easy removal. The toe piece has a flat kicking surface and the interior of the toe cup may include suitable padding to provide cushioning and for better fit.

6 Claims, 6 Drawing Sheets

KICKING AID

FIELD OF THE INVENTION

The present invention relates to a device for use in athletic contests and more particularly relates to a kicking aid which may be attached to an athletic shoe to assist in the performance of kickers, particularly when kicking a football in straight-on or conventional fashion.

BACKGROUND OF THE INVENTION

Kicking is an important and integral part of the American football game. The game is begun with a kickoff in which the ball is placed on a kicking tee at the 35 yardline and the kicker normally attempts to kick the ball as deep and high as possible to prevent the receiving team from returning the ball or to limit the possibility of a run back.

In some situations, the kicking team will attempt a short, onside kick in which the strategy is to kick the ball in a manner that once it has traveled 10 yards, the ball will be difficult for the receiving team to recover giving the kicking team the opportunity to recover the ball.

A point after touchdown (Pat's) and field goals are generally attempted by the ball being centered to a player who places the ball on the ground and the kicker will attempt to kick the ball so it passes between the vertical uprights and above the crossbar of the goal post. With a successful field goal attempt, the kicking team is awarded three points and the kicking awarded one point for a successful point conversion after touchdown.

Since the American football is generally oval in shape, several kicking styles have evolved. The traditional kicking style is the straight-on style in which the ball is impacted by the toe of the kicker below the mid point of the ball with the kicker's foot and leg on an arcuate path directed toward the target area, in the case of a field goal, between the goal post uprights. However, the oval configuration of the football, along with the shape and structure of a conventional football shoe, make it difficult for the kicker to consistently kick with the accuracy required, particularly when conditions such as weather and the rush of oncoming defensive players may effect the kicker.

As a result, some athletes have developed other kicking techniques. One such popular kicking technique, as an alternate to the straight-on or the toe kicking technique, is the soccer style technique. With the soccer style technique, the kicker generally approaches the football at an angle, rather than in a direct line with the intended ball path. The kicker will also generally impact the ball with the leg and foot assuming a more swinging, arcuate path. While many kickers have been successful with this style, it has disadvantages and it is generally more difficult for the kicker to be accurate using the style. Often the result is that the kicker will hook or pull the ball, misdirecting it from its intended flight path.

As a result, various kicking aids have been developed and can be found in the prior art. For example, there are a number of kicking aids to assist the soccer style kicker which claim to improve accuracy for the soccer style kick and to improve the distance and control of the trajectory of the kicked ball to minimize the hook, slice or shank and also to provide cushioning for the comfort of the kicker. Generally these devices consist of some type of padding that is integral with the shoe or may be attached about the shoe in the instep area. Reference is made to the following U.S. Pat. Nos. 5,437,112, 4,617,746 and 4,422,249, which show representative athletic shoe constructions of this general type. Several prior art patents also deal with kicking toes or shoes intended primarily for use by conventional or straight-on kickers.

U.S. Pat. No. 3,851,410 shows a football kicking toe removably mounted on the tip portion of the toe of a shoe having an elastic strap which extends along the shoe sides and behind the heel. A substantially vertical ball-engaging face extends across the front of the toe and may include vertical ribs formed to minimize friction.

U.S. Pat. No. 5,718,069 shows an athletic designed for kicking a football having a toe portion that extends upwardly at an angle, as for example 25° to 38°, with respect to the horizontal plane of the heel and instep portions of the shoe. The device of the '069 patent is integrally formed in the shoe and is not a separate attachment.

In view of the foregoing, it is apparent there nevertheless exists a need for a convenient, easy-to-use, removable kicking aid for use by conventional straight-on style kickers which will enhance the kicker's accuracy.

BRIEF SUMMARY OF THE INVENTION

Briefly, the present invention relates to a kicking aid to assist kickers utilizing a straight-on style to more accurately kick a football. The device is removably attachably to the kicker's athletic shoe. The device has a toe piece which has a flat or planar front kicking surface and which tapers rearwardly conforming to the general shape of the toe of the shoe. A pair of elastic straps are secured to the opposite sides of the kicking shoe toe piece and are provided with fasteners, preferably loop-and-hook type closures. The straps each extend around the heel or counter area of the shoe and the end of each strap is attachable to the outer surface of the opposite strap near the toe piece. Preferably the toe piece is made out of a sturdy material such as leather or synthetic leather such as polyurethane. The bottom or sole portion of the toe piece may be provided with a hole which is positioned and sized to receive the front cleat on the kicker's shoe for stability. The inside of the toe piece defines a shoe receiving cup. The interior of the cup, rearward of the planar kicking surface, may include a padding or cushioning such as an elastomeric foam, to provide a more comfortable fit and to absorb the shock imparted during kicking.

While the kicking device of the present invention is described with reference to straight-on kicking of a football as practiced in American football, the kicking aid has application to other types of kicking, particularly where an oval ball is used in games such as rugby and Australian football rules.

BRIEF DESCRIPTION OF THE DRAWINGS

The above and other objects and advantages of the present invention will be more fully understood from the following description, claims and drawings in which:

DETAILED DESCRIPTION OF THE DRAWINGS

Figure 1:
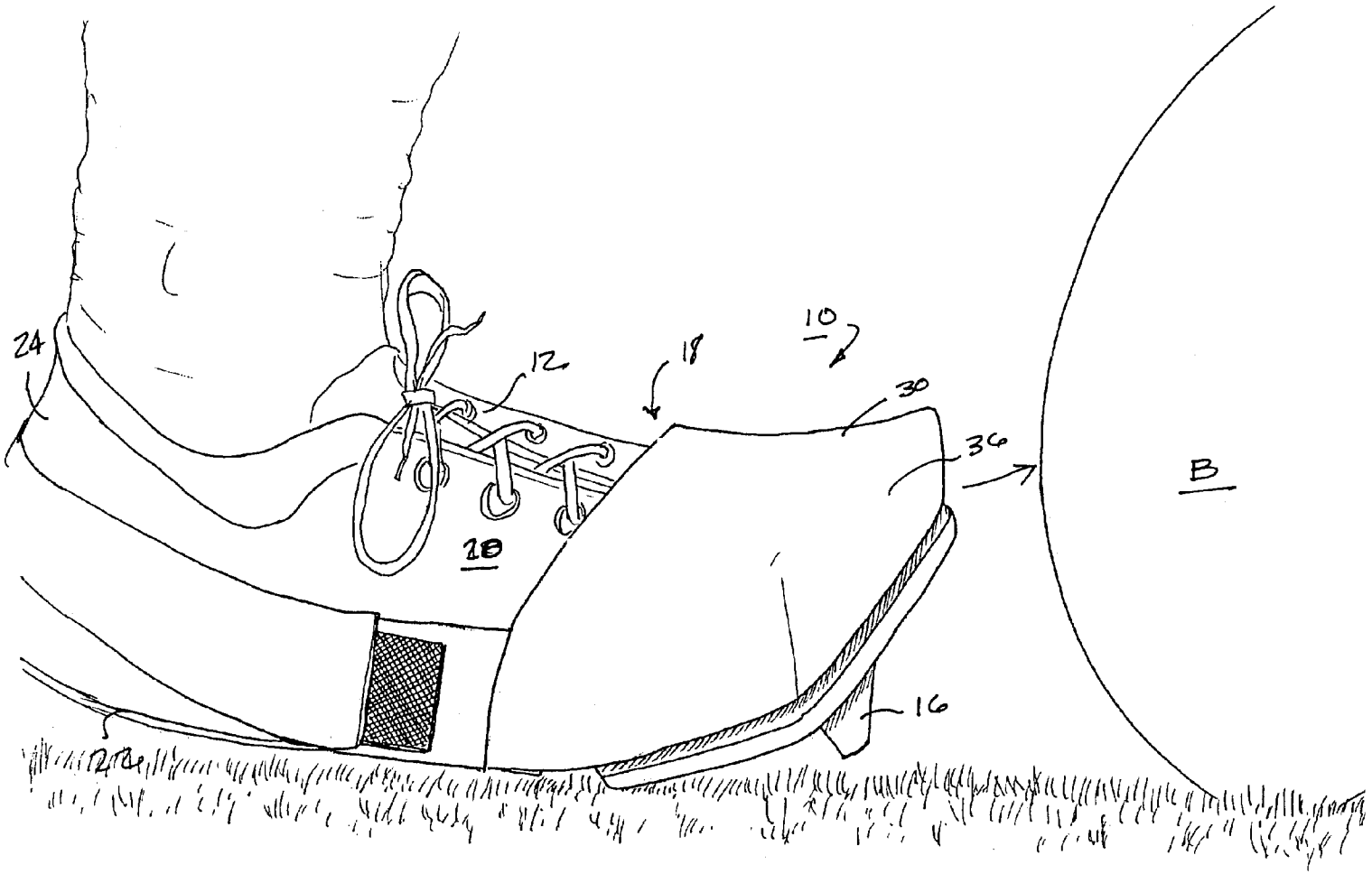
FIG. 1 is a perspective view showing the kicking aid of the present invention attached to the player's shoe with the player's foot adjacent a football.
Figure 2:
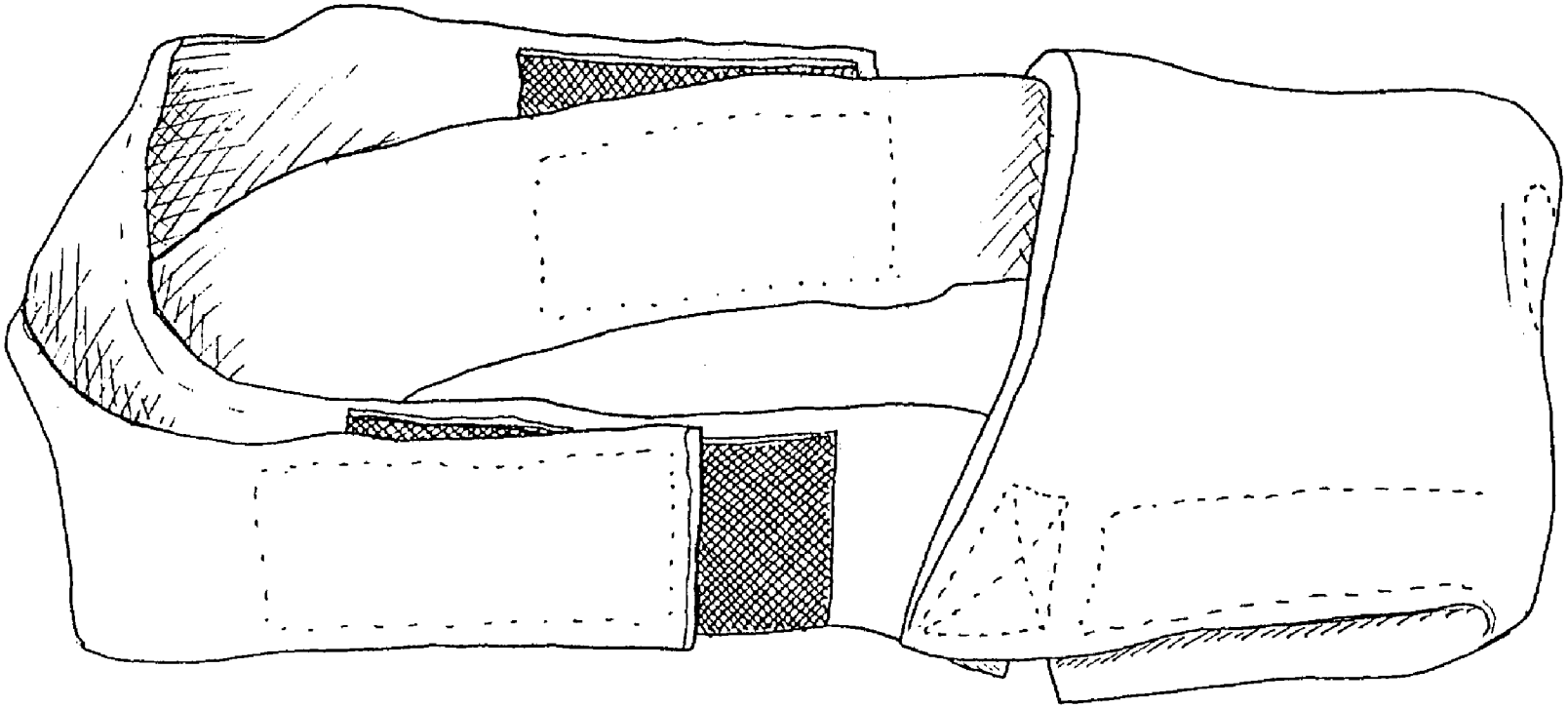
FIG. 2 is another perspective view of the kicking aid of the present invention.

Turning now to the drawings, the kicking aid of the present invention is generally designated by the numeral 10 and is intended to be used in conjunction with the user's athletic shoe 12 such as shown in FIG. 1. FIG. 1 also illustrates the kickers foot approaching a football B. The athletic shoe 12 may be a low or high top style shoe commonly worn by football players having a plurality of either integrally molded or removable cleats on the sole. The traditional cleat pattern has a single front cleat depending from the toe of the kicker's shoe. The football shoe has a toe 18, instep 20, sole 22 and counter 24.

Figure 4:
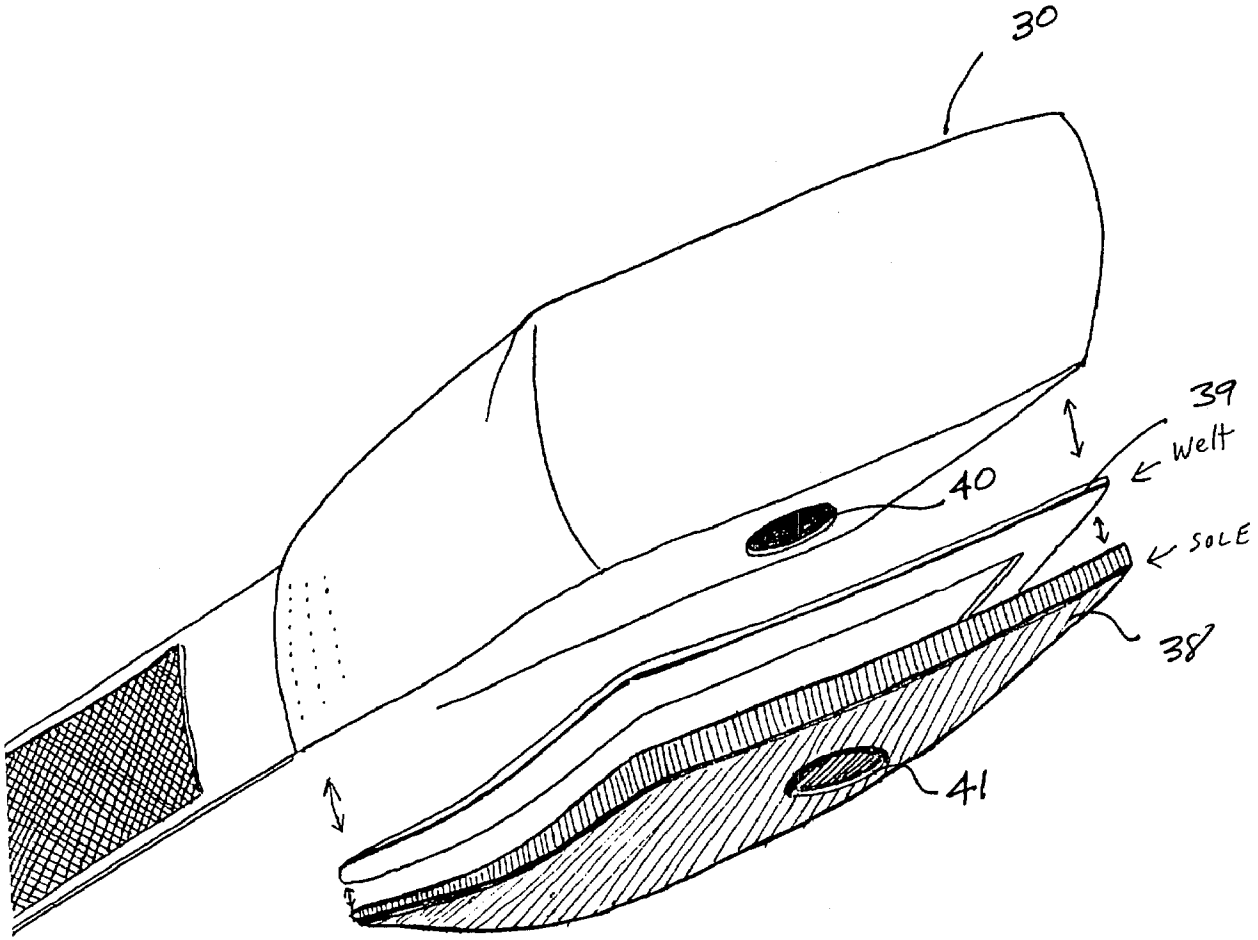
FIG. 4 is an exploded view of the foot portion of the kicking aid to better illustrate the details of construction.

The kicking aid 10 has a toe piece 30 which is preferably fabricated from leather or a synthetic material having the characteristics of leather such as polyurethane. The material should be relative rigid having some flexibility and is preferably not a hard shell material. The toe cup has opposite sides 32, 34 which diverge outwardly from a front kicking surface 36. The kicking surface 36 is generally planar or flat and is preferably generally perpendicular to the field or playing surface when the device is worn, as seen in FIG. 1. The toe piece is completed by a generally flat bottom surface or sole 38. As seen in FIG. 4, the construction may include a welt 39 which extends around the periphery of the lower surface. The sole 38, which may be rubber or other material, is secured to the welt and to the cup by stitching or by a suitable adhesive.

An aperture 40 extends through the bottom surface of the kicking piece and is aligned with another aperture 41 in the sole. The location and size of the apertures 40, 41 are to accommodate insertion of the front cleat 16 which is conventional on the type of athletic shoe worn by most kickers.

The toe piece defines a space or cup 44 which is adapted to receive the toe 18 of the athletic shoe 12. Preferably the toe piece is dimensioned so that the rear surface of the toe piece extends to an area in the area of the vamp or instep section 20 of the shoe, generally at the base of the area occupied by the laces or other closures such as loop-and-hook style closures which are found on some athletic shoes.

Cushioning or padding 50 may be provided in the forward end of the cup at the rear of the kicking surface 26. The padding preferably is an elastomeric foam or similar resilient material which will cushion the impact imparted by kicking and further allow the interior space or cavity 44 within the cup to better conform to the user's foot and shoe.

Figure 3:
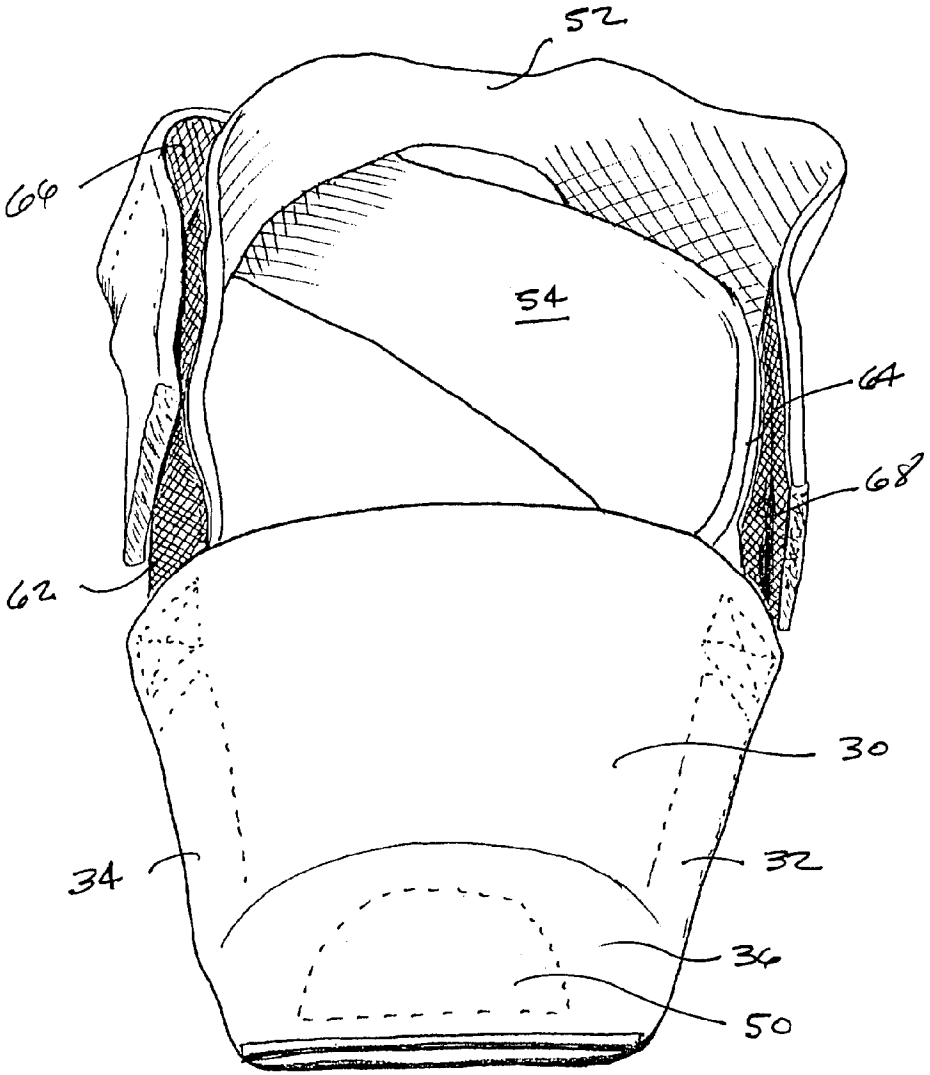
FIG. 3 is a front perspective view of the kicking aid of the present invention.
Figure 5:
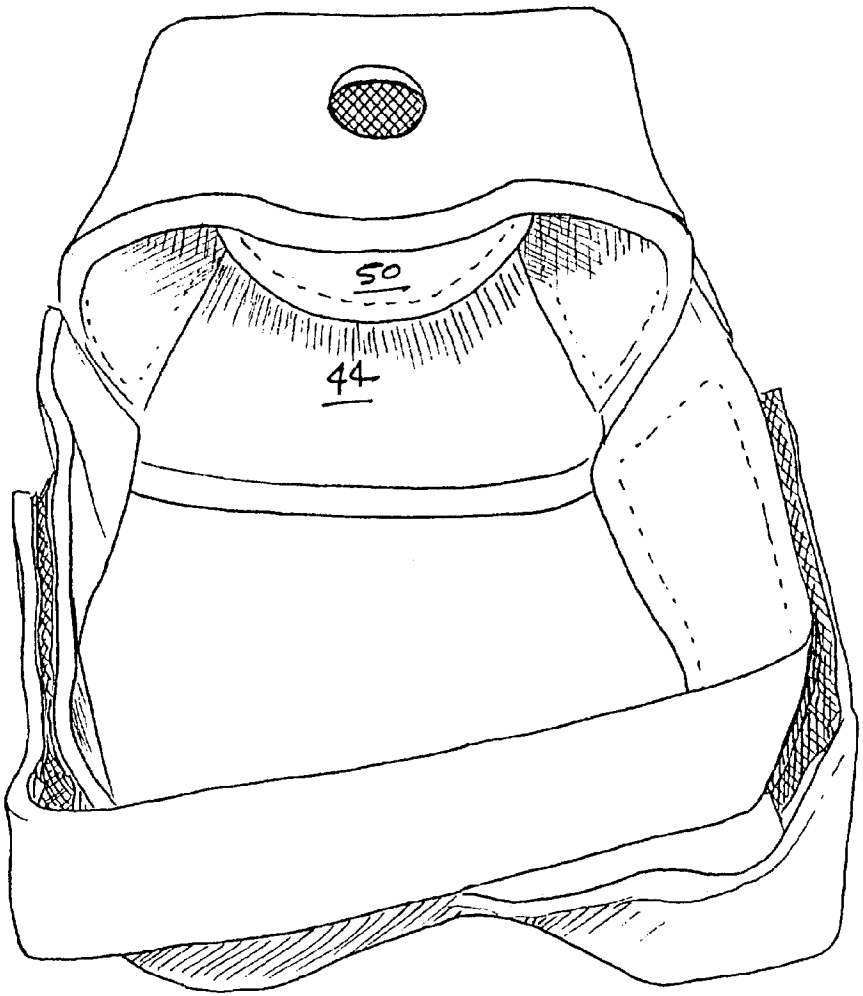
FIG. 5 is a bottom perspective view.

The kicking aid may be quickly and temporarily secured to the user's foot and shoe by a pair of straps 52, 54 which are preferably an elastic material, as best seen in FIGS. 3 and 5. Strap 52 is attached to one side 34 of the toe piece by stitching or other means and has sufficient length to extend around the heel or counter area of the shoe 12 to the opposite side. Similarly, the second strap 54 is attached to side 32 of the shoe and is of sufficient length to extend around the heel or counter area of the shoe to the opposite side 34. Straps 52, 54 are of sufficient width to provide stability, typically being between 1½ to 2½ inches wide. The outer surface of strap 52 is provided with one section 62 of a loop-and-hook closure material in the area adjacent its point of attachment. Similarly, strap 54 also is provided with a section of loop-and-hook closure material 64 in the area adjacent its point of attachment. The ends of the straps 52, 54 each carry mating sections 66, 68 of loop-and-hook closure material so the straps may be snugly secured about the shoe and foot of the user in crossover fashion as seen in FIG. 3.

The wide straps which cross over one another provide both stability and allow the kicking device to be quickly attached conforming to the user's preference as well as physical size and characteristic of the user's shoe. It may be preferable to provide the kicking aid of the present invention in various sizes such as small, medium and large. The small size would typically encompass shoe sizes 1 to 4, medium will fit shoe sizes 5 to 8 and the large size fit shoe sizes 9 and up which generally correspond to sizes which might be used by players in football programs from peewee, junior high and high school through college and professional.

The kicking device of the present invention is intended primarily for straight-on kicking and fits over a regular football shoe with screw-in cleats, as well as those with molded cleats of various configurations. As mentioned above, it is preferred that the device be manufactured from leather or similar material having a rubber sole. While other materials may be used, leather is a material traditionally used in football gear and is a presently acceptable material which may be used in the various levels of football competition.

Figure 6:
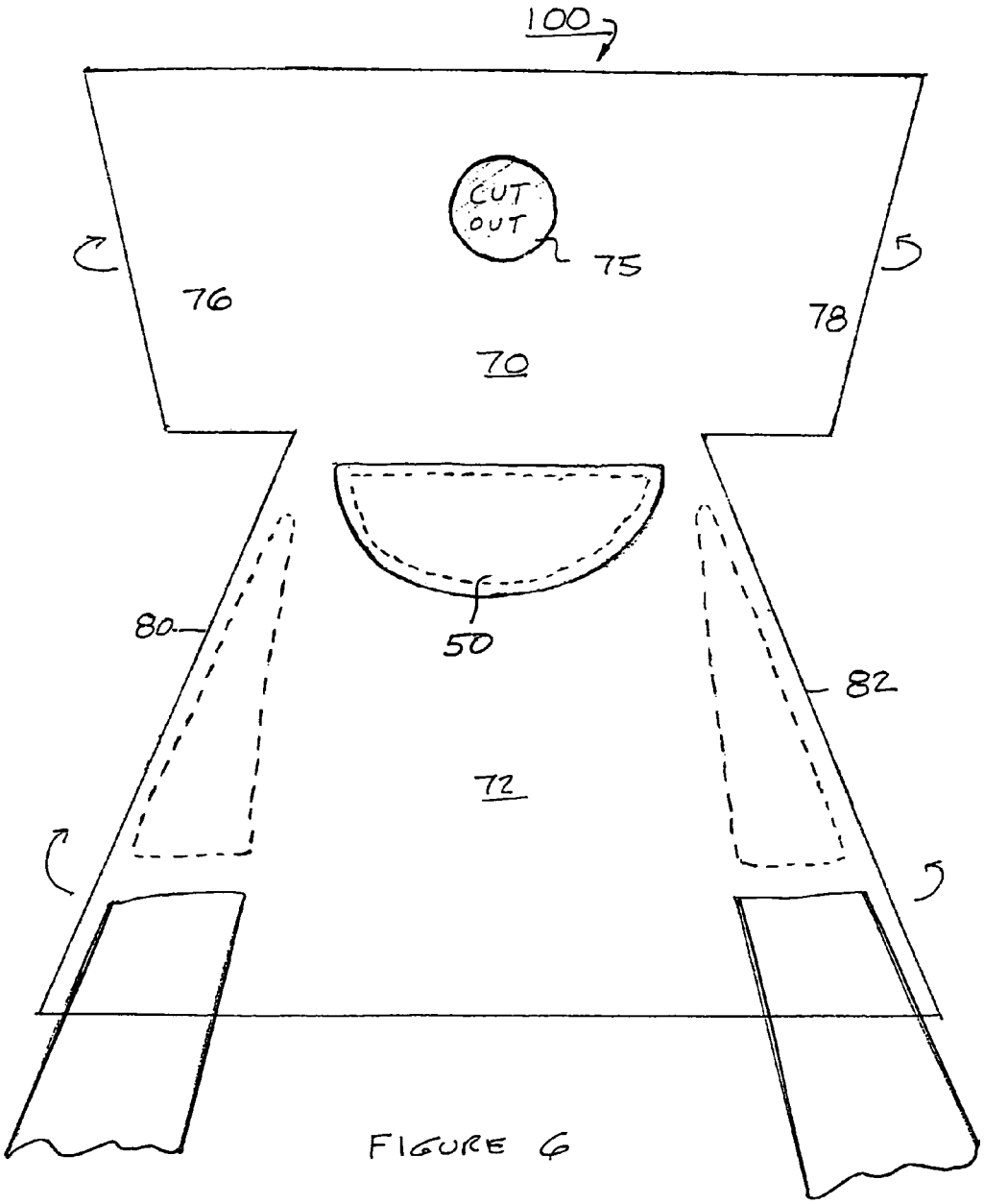
FIG. 6 is a plan view showing a representative pattern for the toe piece.

FIG. 6 illustrates a typical pattern 100 from which the kicking cup portion of the device may be fabricated. The pattern consists of two generally trapezoidal sections 70, 72. The section 70 has a cutout 75 for the aperture 40 for the front cleat. Opposite flaps 76,78 at the side section 70 are folded in and sewn to the lower section 72 at opposite sides 80, 82. The padding 50 is secured to section 72 in the area which will be opposite the planar kicking surface when the assembly is completed.

Straps 52, 54 are attached to the sides by sewing or gluing, or both, after the toe piece has been completed by folding. Side edges 80, 82 fold inwardly and are sewn completing the cup-like configuration. The welt 39 and sole 38 will then be attached to the exterior of the bottom surface as seen in FIG. 4.

The advantage of the kicking aid of the present invention is that it provides substantial generous planar surface 36 with which the kicker impacts the ball when kicking. This generous planar surface provides more accuracy, providing the kicker a greater margin of error when impacting the ball without causing a hook or a shag when the kick is attempted. The insertion of the front cleat 16 through the aperture 40 in the bottom surface of the device provides stability and minimizes slipping or twisting of the device at impact. The use of leather or similar materials, as mentioned above, is consistent with tradition, although other similar materials may be used in the fabrication of the device.

Another advantage is that the kicking aid can be easily and quickly be put on and taken off the shoe normally worn by the player during the game or event. The player does not have to leave the field or change shoes prior to kicking. The device can be given to the kicker while on the field so the player can position it over the toe of a shoe, engaging the cleat in the aperture. The elastic straps 52, 54 can then be extended around the heel of the shoe and foot and each being attached at the opposite side at the loop-and-hook closures. The wide strap and the closure system allows the kicker to attach the device in a manner which is consistent with the preference of the user, is comfortable to the user and which is stable.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A removable football kicking aid for use with an athletic shoe of the type having a toe, heel and sole with a projecting cleat in the front section of the sole, said kicking aid comprising:

(a) a toe piece having a sole, opposite first and second sides having a height and a generally planar front kicking surface, said toe piece defining a cup having an interior for receiving a substantial portion of the athletic shoe extending from the toe to the vamp;

(b) a first flexible strap attached to the first side of the toe piece and having a free end which is extendable around the heel of the athletic shoe to a location on the opposite second side in a fastened position, said first strap having a width substantially corresponding to the height of the first side;

(c) a second flexible strap attached to the second side of the toe piece and having a free end which is extendable around th heel of the athletic shoe to a location on the opposite first side in a fastened position, said second strap having a width substantially corresponding to the height of the second side;

(d) fastener means associated with said first and second straps for securing said straps in a fastened position; and (e) said toe piece sole defining an aperture located to receive said projecting cleat in the front of the athletic shoe sole to stabilize the toe piece.

2. The football kicking aid of claim 1 wherein said straps are elastic and are at least 1" wide.

3. The football kicking aid of claim 1 wherein said toe piece is leather.

4. The football kicking aid of claim 1 wherein said toe piece is synthetic leather.

5. The football kicking aid of claim 1 wherein said kicking surface is generally perpendicular to the playing field when the aid is worn.

6. The football kicking aid of claim 1 wherein said cup interior includes cushioning material at the rear of the kicking surface.

* * * * *